US005484759A

United States Patent [19]

Suto et al.

[11] Patent Number: 5,484,759

[45] Date of Patent: Jan. 16, 1996

[54] IMAGE-RECEIVING SHEET

[75] Inventors: Kenichiro Suto; Mikio Asajima; Koichi Higaki, all of Tokyo, Japan

[73] Assignee: Dai Nippon Printing Co., Ltd., Japan

[21] Appl. No.: 257,689

[22] Filed: Jun. 7, 1994

[30] Foreign Application Priority Data

| | | | |
|---|---|---|---|
| Jun. 8, 1993 | [JP] | Japan | 5-163267 |
| Sep. 24, 1993 | [JP] | Japan | 5-258842 |
| Sep. 24, 1993 | [JP] | Japan | 5-258843 |
| Feb. 9, 1994 | [JP] | Japan | 4-036609 |

[51] Int. Cl.[6] ..... B41M 5/035; B41M 5/38

[52] U.S. Cl. ..... 503/227; 428/195; 428/319.3; 428/319.7; 428/913; 428/914

[58] Field of Search ..... 428/195, 318.4, 428/913, 914, 319.3, 319.7; 503/227; 8/471

[56] References Cited

U.S. PATENT DOCUMENTS

| | | | |
|---|---|---|---|
| 4,621,009 | 11/1986 | Lad | 428/216 |
| 4,990,485 | 2/1991 | Egashira et al. | 503/227 |
| 5,156,709 | 10/1992 | Mammino et al. | 156/235 |

FOREIGN PATENT DOCUMENTS

| | | | |
|---|---|---|---|
| 0403311 | 12/1990 | European Pat. Off. | 428/195 |
| 0433950 | 6/1991 | European Pat. Off. | 428/195 |
| 0501360 | 9/1992 | European Pat. Off. | 428/195 |
| 0514977 | 11/1992 | European Pat. Off. | 428/195 |
| 2644089 | 4/1978 | Germany | 428/195 |

OTHER PUBLICATIONS

Patent Abstracts of Japan, vol. 14, No. 214 (P–1044) 7 May 1990 & JP–A–02 047 667 (Sato Kazuo) 16 Feb. 1990.

Patent Abstracts of Japan, vol. 7, No. 270 (P–240) 2 Dec. 1983 & JP–58 150 966 (Fuji Xerox KK) 7 Sep. 1983.

Patent Abstracts of Japan, vol. 15, No. 418 (P–1266) 23 Oct. 1991 & JP–A–03 170 944 (Ricoh Co. Ltd.) 24 Jul. 1991.

Patent Abstracts of Japan, vol. 7, No. 210 (P–223) 16 Sep. 1983 & JP–A–58 105 157 (Fuji Xerox KK) 22 Jun. 1983.

*Primary Examiner*—B. Hamilton Hess
*Attorney, Agent, or Firm*—Parkhurst Wendel & Rossi

[57] ABSTRACT

An image-receiving sheet including a substrate sheet, an image-receiving layer and, as a detection mark, an opaque porous resin layer that becomes transparent upon heating, the opaque porous resin layer being formed by coating a resin varnish including a resin, a good solvent having a relatively low boiling point and a poor solvent having a relatively high boiling point on the image-receiving sheet and drying the resultant coating. Also disclosed is an image-receiving sheet including a substrate sheet and an image-receiving layer, the image-receiving layer being composed mainly of a polyester resin including an acid moiety and a diol moiety of a modified bisphenol A represented by the following general formula (I):

(I)

wherein R represents an ethylene or propylene group and x and y are each an integer of 1 to 5, provided that the average of each of x and y is 1 to 3.

5 Claims, 1 Drawing Sheet

IMAGE-RECEIVING SHEET

BACKGROUND OF THE INVENTION

1. Field of the Invention

This invention relates to an image-receiving sheet. More particularly, it relates to an image-receiving sheet for an overhead projector.

2. Background Art

An overhead projector (OHP) is an information transmission means which is used extensively in lecture meetings, schools, etc. Handwriting with an oil-base ink, printing and electrophotographic copying have hitherto been used as means for forming an image on an image-receiving sheet for OHP (hereinafter referred to as an "OHP sheet"). In order to steadily record and hold thereon image information, such as lines, letters and pictures, using the above means, OHP sheets generally have an image-receiving layer on a transparent substrate sheet. Therefore, the side of the image-receiving layer in an OHP sheet, on which information is to be recorded, should be surely distinguished from the other side of the sheet. For this reason, a detection mark, for example, a white arrow, for identifying the side of the image-receiving layer, that is, distinguishing the two sides of an OHP sheet is put on the sheet surface. This marking also serves to mechanically distinguish an OHP sheet from other types of paper.

Further, some electrophotographic copying machines are designed to begin work upon detection of the position of the sheet within the machine at the time of copying, which needs OHP sheets with a white detection mark formed thereon.

The above detection mark becomes unnecessary upon the formation of an image. Rather, the presence of a detection mark after the formation of an image on an OHP sheet gives rise to the problem that when the OHP sheet is applied to an overhead projector, the detection mark is unfavorably projected together with the necessary image, so that the copresence of the unnecessary image on the projected image face deteriorates the quality of the projected image and sometimes makes it difficult to clearly see the contemplated image.

In view of the problem associated with the detection mark, Japanese Patent Laid-Open No. 170944/1991 teaches a detection mark for an OHP sheet, comprising an opaque porous resin layer that becomes transparent when heated at the time of forming an image by means of electrophotographic copying. Proposed methods for producing such a porous resin layer are 1) a method which comprises incorporating a foaming agent during or after coating of a hydrophobic resin, such as a polystyrene resin or a polyester resin, on a substrate and conducting foaming and 2) a method which comprises coating the above-described hydrophobic resin together with an extractable resin or solvent on a substrate and then rendering the resultant coating porous by carrying out a water or solvent extraction.

According to studies made by the present inventors, however, it has been found that the method 1) is disadvantageous in that not only the opacity of the detection mark is low but also the detection mark cannot be sufficiently rendered transparent by heating, and the method 2) has the drawbacks that the extraction step requires a considerable time and the extractant should be used in large amount.

On the other hand, OHP sheets for an electrophotographic copying machine raise the following problems particularly when a multi-color image is formed by using a multi-color copying machine.

Specifically, when a multi-color image is formed on an OHP sheet, toners of three or four colors are usually put on top of another and heat-fixed. This causes the thickness derived from the superimposition of toners to become larger than that in the case of formation of a monochromatic image, so that the surface of the print after heat fixing is likely to become uneven. In this case, at the time of projection, the incident light scatters in the uneven portions, which renders color reproduction of the projected image, particularly at highlight portions, unsatisfactory. That is, clouding (graying) of the image projected by OHP occurs.

Japanese Patent Laid-Open No. 198063/1991 proposes an image-receiving sheet comprising a coating of a material having a melting point above room temperature but below the fixing temperature of the toner and compatible with a binder resin for a color toner, and Japanese Patent Laid-Open No. 125567/1992 proposes a penetrable transfer medium comprising a toner-image-holding layer containing a thermoplastic resin having a softening point below that of a color toner. In these proposals, in order to solve the above-described problem, the softening point or melt viscosity of the image-receiving resin are specified so that the toner penetrates into the image-receiving layer to provide a print having a reduced surface unevenness. Further, Japanese Patent Laid-Open No. 47667/1990 proposes an OHP sheet comprising a porous surface layer comprised of a polyester resin.

An object of the present invention is to provide an OHP sheet having a detection mark capable of being rendered transparent upon heating, which OHP sheet is free from the problem of the prior art.

Another object of the present invention is to provide an image-receiving sheet capable of forming a high-quality multi-color image that can provide an image free from clouding (graying) when applied to OHP.

SUMMARY OF THE INVENTION

In order to attain the above-described objects, according to the first aspect of the present invention, there is provided an image-receiving sheet comprising a substrate sheet, an image-receiving layer and, as a detection mark, an opaque porous resin layer capable of being rendered transparent upon heating, said opaque porous resin layer comprising a layer formed by coating a resin varnish comprising a resin, a good solvent having a relatively low boiling point and a poor solvent having a relatively high boiling point on said image-receiving sheet and drying the resultant coating. According to the second aspect of the present invention, there is provided an image-receiving sheet comprising a substrate sheet and an image-receiving layer, said image-receiving layer being composed mainly of a polyester resin comprising an acid moiety and a diol moiety of a modified bisphenol A represented by the following general formula (I):

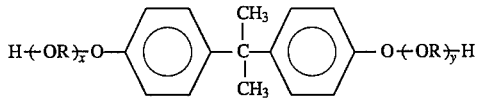

(I)

wherein R represents an ethylene or propylene group and x and y are each an integer of 1 to 5, provided that the average of x and y is 1 to 3.

In the image-receiving sheet according to the first aspect of the present invention, the detection mark produced by the particular method is very excellent in opacity and capability of being rendered transparent upon heating at the time of forming an image. Further, the detection mark has none of the problems of the prior art associated with production thereof, such as complicated production processes and use of a large amount of an extraction solvent, and a high-quality detection mark can be provided by a simple process with a good reproducibility.

In the image-receiving sheet according to the second aspect of the present invention, the image-receiving layer composed mainly of a particular polyester resin has a good compatibility with a binder resin for a toner, which contributes to an improvement in thermal and chemical properties, that is, an improvement in adhesion to the toner and color development. This enables a high-quality multi-color image to be formed without clouding (graying) of image on projection with OHP.

DETAILED DESCRIPTION OF THE INVENTION

Figure 1:
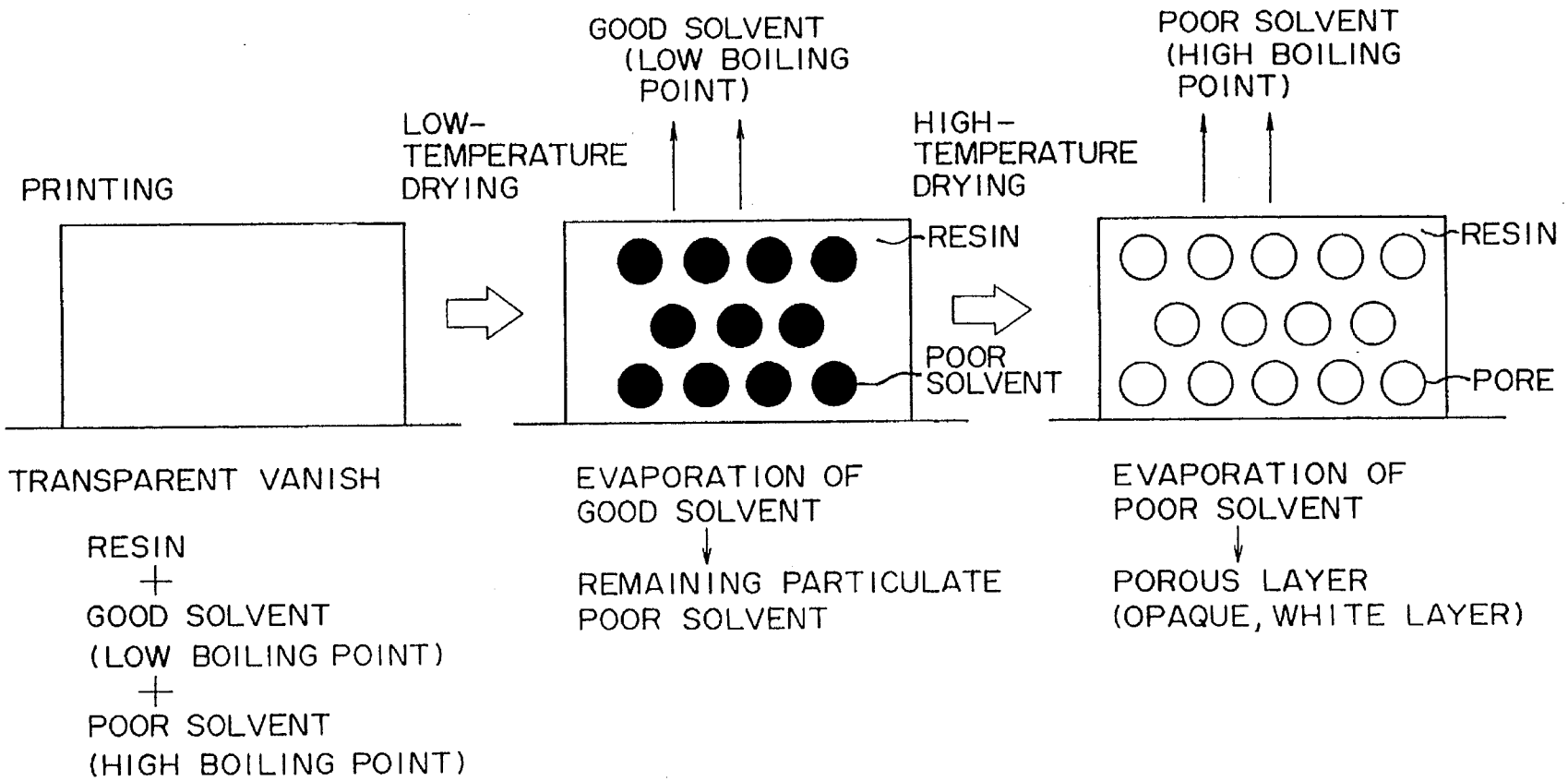
FIG. 1 is a conceptual diagram showing an embodiment of a detection mark production process according to the present invention.

I. Image-receiving sheet having a detection mark that can turn transparent upon heating:

The image-receiving sheet according to the first aspect of the present invention comprises a substrate sheet, an image-receiving layer and, as detection mark, an opaque porous resin layer that can turn to be transparent upon heating, said opaque porous resin layer being formed by coating a resin varnish comprising a resin, a good solvent having a relatively low boiling point and a poor solvent having a relatively high boiling point on said image-receiving sheet and drying the resultant coating.

Stretched or unstretched transparent films or sheets of various plastics, such as polypropylene, polyvinyl chloride, polyethylene terephthalate, polymethacrylates, polycarbonates, cellulose triacetate, cellulose diacetate, polyamides, saponification products of ethylene/vinyl acetate copolymer, polyarylates and polyethersulfone, may be used as the substrate sheet.

The thickness of the substrate sheet may be properly determined depending on the recording means to be used, necessary strength and rigidity, and the like. It, however, is usually in the range of from 50 to 300 μm.

The image-receiving layer is formed on the substrate sheet directly or through a primer layer.

Examples of the resin for forming the image-receiving layer include polyolefin resins, such as polyethylene and polypropylene, vinyl resins, such as polyvinyl chloride, polyvinylidene chloride, polyvinyl acetate, vinyl chloride/vinyl acetate copolymer, polyacrylic esters and polystyrene, polyester resins, such as polyethylene terephthalate and polybutylene terephthalate, polyamide resins, copolymers of olefins, such as ethylene and propylene, with other vinyl monomers, ionomers, cellulosic resins, such as ethyl cellulose, cellulose acetate, and polycarbonate resins. Among them, vinyl resins and polyester resins are particularly preferred. Especially, for the image-receiving sheet to be appled to electrophotographic copying machines, the specific polyester resin comprising an acid moiety and the specific diol moiety according to the second embodiment of the present invention is preferably used. Further, resins dyeable with sublimable dyes and resins receptive to hot-melt inks may also be used as the resin for forming the image-receiving layer.

The image-receiving layer may be formed by adding various optional assistants to the above resin component, dissolving or dispersing the mixture in a suitable solvent to prepare a coating composition, coating the composition on a substrate sheet by any conventional method and drying the resultant coating. The thickness of the image-receiving layer is usually in the range of from 1 to 20 μm.

A primer layer may be optionally provided between the image-receiving layer and the substrate sheet for the purpose of stabilizing the adhesion between the substrate sheet and the resin for forming the image-receiving layer. The primer layer may comprise a conventional material selected from linear polyesters, isocyanates and the like.

In order to prevent the image-receiving layer from being contaminated with dust, an antistatic layer containing the following surfactant may be provided on an image-receiving layer as well as on the back surface of the substrate sheet.

It is possible for the antistatic layer provided on the back surface of the substrate sheet to comprise a resin identical to that in the image-receiving layer from the viewpoint of preventing curling of the sheet.

An antistatic agent may be incorporated in the image-receiving layer. In this case, any conventional antistatic agent may be used so far as it is dispersible in the system in the formation of an image-receiving layer. Cationic, anionic, amphoteric and nonionic surfactants may be used as the surfactant. More specific examples of the antistatic agent include cationic antistatic agents, such as quaternary ammonium salts and polyamine derivatives, anionic antistatic agents, such as alkyl phosphates, and nonionic antistatic agents, such as fatty acid esters.

When the antistatic layer is provided on the outermost layer of the sheet, if necessary, a lubricant may be incorporated in the antistatic layer so that the sheet can be slid smoothly upon toner-fixing and carried stably.

In order to prevent a plurality of image-receiving sheets from being traveled together in an overlapped state due to blocking during feed of the image-receiving sheet to a printer, or a failure of the sheet to be carried within the printer, it is also possible to incorporate inoragnic or organic fine particles in the above lubricant and/or in the image-receiving layer. In this case, the fine particles used should not detrimental to the transparency of the sheet. Examples of such fine particles include fine particles of materials having a refractive index close to that of the binder for the image-receiving layer, for example, inorganic fine particles, such as silica, talc, alumina and calcium carbonate, and organic fillers, such as fine particles of teflon, crosslinked urea resins, styrene/acrylic resin, melamine resin and polycarbonate.

The detection mark of the present invention is formed as an opaque porous resin layer by coating a resin varnish comprising a resin, a good solvent having a relatively low boiling point and a poor solvent having a relatively high boiling point on an image-receiving sheet (on the surface of the image-receiving layer or on the back surface of the sheet) and drying the resultant coating.

FIG. 1 is a conceptual diagram showing a process for producing the detection mark.

As shown in FIG. 1, at the outset, a transparent resin varnish comprising a resin, a good solvent having a relatively low boiling point and a poor solvent having a relatively high boiling point is coated on the surface of the image-receiving layer of the image-receiving sheet or on the back surface of the sheet, that is, the surface of the image-receiving sheet remote from the image-receiving layer. The coating of the varnish may be carried out by any conventional printing method, such as gravure printing or silk screen printing, usually at a coverage of 0.5 to 10 μm. The printed resin varnish is then dried. In the stage of drying, the good solvent having a relatively low boiling point is preferentially evaporated. The progress of the evaporation of the good solvent gives rise to phase separation between the resin phase and the remaining poor solvent in the resin varnish. As a result, the resin gels while the remaining poor solvent is dispersed in a particulate form. Further progress of drying goes on with evaporation of the remaining poor solvent in a particulate form having a relatively high boiling point, and a porous opaque (white) resin layer is formed upon the completion of evaporation of the poor solvent.

In the above-described process, drying may be carried out in a single step. However, it is preferred to carry out two-step drying wherein the coating is dried first at a low temperature to complete the evaporation of substantially the good solvent having a relatively low boiling point alone and then dried at a high temperature to evaporate the remaining poor solvent.

Drying conditions may be varied depending upon the kinds of resin, good solvent and poor solvent used, desired pore diameter and the like. In general, however, the one-step drying is preferably carried out at a temperature in the range of from 80° to 100° C. for 3 to 10 seconds, and in the case of the two-step drying, the low-temperature drying is preferably carried out at a temperature in the range of from 10° to 30° C. for 0.5 to 5 seconds with the high-temperature drying being preferably carried out at a temperature in the range of from 80° to 120° C. for 1 to 5 seconds. Further, the low-temperature drying in the two-step drying is preferably carried out under calm conditions.

Preferred examples of the resin used in the production of the detection mark according to the present invention include acrylic resin, polyester resin and vinyl chloride/vinyl acetate compolymer. Among them, vinyl chloride/vinyl acetate copolymer resin is particularly preferred. It is preferred for the melting point of these resins to be in the range of from 30° to 150° C., particularly preferably in the range of from 50° to 130° C. When the melting point exceeds 150° C., there is a fear that upon melting of the porous resin layer at the time of formation of an image (fixation of the toner) the substrate may also be thermally deformed. On the other hand, the use of resins having a melting point of 30° C. or below is unfavorable from the viewpoint of storage stability.

The above-described resins may be used alone or as of a mixture of two or more.

Poor solvents for the above-described resins include hydrocarbon solvents, such as aliphatic hydrocarbons, aromatic hydrocarbons and terpene hydrocarbons, halogenated hydrocarbons and alcohols. Good solvents for solvent-soluble resins among the above-described resins include ketones, such as acetone, methyl ethyl ketone and cyclohexane, esters, such as ethyl acetate, butyl acetate and ethylene glycol acetate monomethyl ether, and for some resins, aromatic hydrocarbons and alcohols. When a water-soluble resin is used, a poor solvent for a solvent-soluble resin may be used as a good solvent and a good solvent for a solvent-soluble resin as a poor solvent.

The poor solvent is used generally in an amount of 10 to 70 parts by weight based on 100 parts by weight of the resin.

As will be understood from the above description in connection with the detection mark production process, the boiling point of the poor solvent must be relatively higher than that of the good solvent. Further, from the viewpoint of stable dispersion in the resin varnish, it is preferred to use a combination of good and poor solvents that are soluble in each other.

In the detection mark according to the present invention, it is also possible to further incorporate a particulate lubricant in the resin varnish. Use of the lubricant accelerates evaporation of the solvent during drying of the resin varnish, whereby the productivity of the detection mark is increased. Further, the use of the lubricant can improve the coating strength of the detection mark as a printed coating, which contributes to an improvement in scratch resistance.

The lubricant is preferably a particulate organic lubricant having a particle diameter in the range of from 0.5 to 20 μm. Examples thereof include particles of aliphatic hydrocarbons, such as pertroleum wax, synthetic paraffins, polyethylene wax and montan wax, higher fatty acids and metal salts thereof, such as palmitic acid and stearic acid and aluminum, tin and zinc salts thereof, aliphatic alcohols, aliphatic esters, such as n-butyl stearate, n-hexyl stearate and octyl stearate, amides, such as stearic acid amide, palmitic acid amide and ethylenebispalmitic acid amide, and wax, such as carnauba wax.

The amount of the lubricant used is generally in the range of from 0.5 to 30% by weight, preferably in the range of from 1 to 5% by weight, based on the resin.

It is preferred for the porous resin layer as the detection mark to have an average pore diameter in the range of from 0.05 to 2_μm.

When the average pore diameter is less than 0.05 μm, no good opacity (whitening) can be attained, so that the function of the detection mark is unsatisfactory. On the other hand, when it exceeds 2 μm, the coating strength becomes low.

The pore diameter in the porous resin layer can be regulated in the above range by optimizing the drying temperature, air flow for drying, drying time, mixing ratio of the poor solvent to the good solvent, etc.

In the detection mark thus formed, the resin component is melted by heat (100° to 150° C.) of a hot roll for fixing the toner to the image-receiving sheet in the stage of formation of an image by using an electrophotograhic copying machine and then solidified again, which turns the detection mark to be transparent.

In the detection mark according to the present invention, the transmittance in a wavelength region of from 400 to 1000 nm is not more than 50% before printing and not less than 75% after printing, and the reflectance is not less than 20% before printing and not more than 10% after printing.

The detection mark can be provided on the surface of the image-receiving layer or the back surface of the image-receiving sheet remote from the image-receiving layer. When the detection mark is provided on the back surface, it may be formed between the substrate sheet and the antistatic layer or on the surface of the antistatic layer. The shape and the number of the detection marks are not particularly limited and may be suitably selected.

Further, the detection mark according to the present invention may be used also for image-receiving sheets for sublimation transfer, hot-melt transfer and ink jet recording.

The first aspect of the present invention will now be described in more detail with reference to the following examples and comparative example, wherein all parts and % are by weight unless otherwise specified.

EXAMPLE I-1

A 100 μm-thick polyethylene terephthalate film (T-60 manufactured by Toray Industries, Inc.) was provided for use as a substrate sheet, and the following coating solution for a primer layer was coated on one surface of the substrate sheet by means of a bar coater at a coverage of 1 g/m$^2$ on a dry basis. A coating solution having the following composition for an image-receiving layer was coated on the primer layer by means of a bar coater at a coverage of 5.0 g/m$^2$ on a dry basis to form an image-receiving layer.

A coating solution having the following composition for a back surface layer was coated on the back surface of the substrate sheet, that is, the surface of the substrate sheet remote from the image-receiving layer at a coverage of 1 g/m$^2$ on a dry basis to form a back surface layer, and an ink A having the following composition for a detection mark was printed on the back surface layer to a thickness of 2 to 3 μm on a dry basis by using a gravure printing machine and dried at 80° C. for 5 seconds to whiten the detection mark, followed by sheeting to provide an OHP sheet for an electrophotographic copying machine.

| Coating solution for image-receiving layer | |
|---|---|
| Polyester resin (Vylon 600 manufactured by Toyobo Co., Ltd.) | 4 parts |
| Vinyl chloride/vinyl acetate copolymer resin (Denkalac #1000A manufactured by Denki Kagaku Kogyo K.K.) | 6 parts |
| Methyl ethyl ketone:toluene = 1:1 | 90 parts |
| **Coating solution for primer layer** | |
| Polyester polyol (Adcoat manufactured by Toyo Morton Ltd.) | 15 parts |
| Methyl ethyl ketone:toluene = 2:1 | 85 parts |
| **Ink A for detection mark** | |
| Acrylic resin (BR-85 manufactured by Mitsubishi Rayon Co., Ltd.) | 20 parts |
| Antistatic agent (TB-34 manufactured by Matsumoto Yushi Ceiyaku Co., Ltd.) | 2 parts |
| Lubricant teflon filler (Daikin Polyflon Tef Low Polymer L-5 having a particle diameter of 7 μm, manufactured by Daikin Industries, Ltd.) | 2 parts |
| Good solvent (toluene:methyl ethyl ketone = 1:1) | 56 parts |
| Poor solvent (Isoper H (mixture of $C_{10}$–$C_{14}$ aliphatic hydrocarbons) manufactured by ESSO) | 20 parts |
| **Coating solution for back surface layer** | |
| Cationic acrylic resin (Saftomer No. 13 having a solid content of 35%, manufactured by Mitsubishi Petrochemical Co., Ltd.) | 65 parts |
| Antistatic agent (TB-34 manufactured by Matsumoto Yushi Seiyaku Co., Ltd.) | 1 part |
| Lubricant teflon filler (Daikin Polyflon Tef Low Polymer L-5 having a particle diameter of 7 μm, manufactured by Daikin Industries, Ltd.) | 2 parts |
| Ethanol | 32 parts |

EXAMPLE I-2

An OHP sheet was prepared in the same manner as in Example I-1, except that an ink B having the following composition for a detection mark was used instead of the ink A.

| Ink B for detection mark | |
|---|---|
| Polyester resin (Vylon 290 manufactured by Toyobo Co., Ltd. ) | 20 parts |
| Antistatic agent (TE-34) | 2 parts |

-continued

| Ink B for detection mark | |
|---|---|
| Lubricant (Daikin Polyflon Tef Low Polymer L-5) | 2 parts |
| Good solvent (toluene:methyl ethyl ketone = 1:1) | 56 parts |
| Poor solvent (Isoper H) | 20 parts |

EXAMPLE I-3

An OHP sheet was prepared in the same manner as in Example I-1, except that in ink C having the following composition for a detection mark was used instead of the ink A.

| Ink C for detection mark | |
|---|---|
| Polyester resin (Vylon 600) | 20 parts |
| Antistatic agent (TB-34) | 2 parts |
| Lubricant (Daikin Polyflon Tef Low Polymer L-5) | 2 parts |
| Good solvent (toluene:methyl ethyl ketone = 1:1) | 56 parts |
| Poor solvent (Isoper H) | 20 parts |

EXAMPLE I-4

An OHP sheet was prepared in the same manner as in Example I-1, except that an ink D having the following composition for a detection mark was used instead of the ink A.

| Ink D for detection mark | |
|---|---|
| Acrylic resin (BR-85 manufactured by Mitsubishi Rayon Co., Ltd.) | 11 parts |
| Vinyl chloride/vinyl acetate copolymer (Brushing Resin A) | 5 parts |
| Poor solvent (Isoper H) | 10 parts |
| Good solvent (toluene) | 70 parts |
| Lubricant (carnauba wax CR-8 having a particle diameter of 5 μm, manufactured by Koyo Kagaku Co., Ltd.) | 4 parts |

EXAMPLE I-5

An OHP sheet was prepared in the same manner as in Example I-1, except that an ink E having the following composition for a detection mark was used instead of the ink A.

| Ink E for detection mark | |
|---|---|
| Acrylic resin (BR-85) | 10 parts |
| Vinyl chloride/vinyl acetate copolymer (Brushing Resin A) | 5 parts |
| Poor solvent (Isoper H) | 10 parts |
| Good solvent (toluene) | 72 parts |
| Lubricant (Daikin Polyflon Tef Low Polymer L-5) | 3 parts |

EXAMPLE I-6

An OHP sheet was prepared in the same manner as in Example I-1, except that an ink F having the following composition for a detection mark was used instead of the ink A.

| Ink F for detection mark | |
|---|---|
| Acrylic resin (BR-85) | 10 parts |
| Vinyl chloride/vinyl acetate copolymer (Brushing Resin A) | 5 parts |
| Poor solvent (Isoper H) | 8 parts |
| Good solvent (toluene) | 73 parts |
| Lubricant (polyethylene wax AF-30 having a particle diameter of 10 μm, manufactured by The Inctec Inc.) | 4 parts |

EXAMPLE I-7

An OHP sheet was prepared in the same manner as in Example I1, except that an ink G having the following composition for a detection mark was used instead of the ink A.

| Ink G for detection mark | |
|---|---|
| Polyester resin (Vylon 600) | 10 parts |
| vinyl chloride/vinyl acetate copolymer (Brushing Resin A) | 5 parts |
| Poor solvent (Isoper H) | 10 parts |
| solvent (toluene) | 72 parts |
| Lubricant (carnauba wax CR-8) | 3 parts |

EXAMPLE I-8

An OHP sheet was prepared in the same manner as in Example I-1, except that an ink H having the following composition for a detection mark as used instead of the ink A.

| Ink H for detection mark | |
|---|---|
| Vinyl chloride/vinyl acetate copolymer (Brushing Regin A) | 18 parts |
| Poor solvent (n-butanol) | 35 parts |
| Good solvent (acetone) | 42 parts |
| Lubricant (carnauba wax CR-8) | 5 parts |

EXAMPLE I-9

An OHP sheet was prepared in the same manner as in Example I-1, except that an ink I having the following composition for a detection mark was used instead of the ink A.

| Ink I for detection mark | |
|---|---|
| Vinyl chloride/vinyl acetate copolymer (Brushing Resin A) | 18 parts |
| Poor solvent (n-butanol) | 35 parts |
| Good solvent (acetone) | 42 parts |
| Lubricant Daikin Polyflon Tef Low | 5 parts |

-continued

| Ink I for detection mark |
|---|
| Polymer L-5) |

EXAMPLE I-10

An OHP sheet was prepared in the same manner as in Example I-1, except that an ink J having the following composition for a detection mark was used instead of the ink A.

| Ink J for detection mark | |
|---|---|
| Vinyl chloride/vinyl acetate copolymer (Brushing Resin A) | 20 parts |
| Acrylic resin (BR-83) | 1.5 parts |
| Good solvent: toluene | 8.0 parts |
| ethyl acetate | 12.0 parts |
| MEK | 7.5 parts |
| acetone | 17.0 parts |
| Poor solvent: n-propanol | 17.0 parts |
| n-butanol | 17.0 parts |
| Fine particles of silica (average particle diameter: 12 μm) | 0.1 part |

COMPARATIVE EXAMPLE I-1

An OHP sheet was prepared in the same manner as in Example I-1, except that an ink K having the following composition for a detection mark was used instead of the ink A.

| Ink K for detection mark | |
|---|---|
| Titanium oxide | 20 parts |
| Polyester resin (Vylon 290) | 20 parts |
| Antistatic agent (TS-34) | 2 parts |
| Lubricant (Daikin Polyflon Tef Low Polymer L-5) | 2 parts |
| Good solvent (toluene:methyl ethyl ketone = 1:1) | 56 parts |

COMPARATIVE EXAMPLE I-2

An OHP sheet was prepared in the same manner as in Example I-1, except that an ink L having the following composition for a detection mark was used instead of the ink A.

| Ink E for detection mark | |
|---|---|
| Polyester resin (Vylon 290) | 20 parts |
| Antistatic agent (TB-34) | 2 parts |
| Lubricant (Daikin Polyflon Tef Low Polymer L-5) | 2 parts |
| Toluene:methyl ethyl katone = 1:1 | 61 parts |

An image was formed on the OHP sheets obtained in the above examples and comparative examples by using an electrophotographic copying machine (Pixel CLC-200 manufactured by Canon Inc.). The transmittance and reflectance of a near infrared ray at 950 nm were measured for the detection marks before and after copying by using the following device. The results are given in Table 1.

| | |
|---|---|
| Measuring device: | Spectrophotometer UV-3100 manufactured by Shimadzu Seisakusho Ltd. |
| Measuring wavelength: | $\lambda = 950$ nm |
| Scanning rate: | Very slow |

Each sheet after copying was applied to an overhead projector to observe whether or not an image derived from the detection mark was present in the projected image. As a result, for all the OHP sheets prepared in the examples of the present invention, any image derived from the detection mark was not observed at all in the projected image. On the other hand, for the sheet prepared in Comparative Example I-1, an image derived from the detection mark was observed clearly in the projected image, and with respect to the sheet prepared in Comparative Example I-2, as is apparent from the data given in Table 1, no opaque (whitened) resin layer which can function as a detection mark could be obtained.

TABLE 1

| | Transmittance, % | | Reflectance, % | |
|---|---|---|---|---|
| Example No. | Before copying | After copying | Before copying | After copying |
| Ex. | | | | |
| I-1 | 18.4 | 90.2 | 39.7 | 5.2 |
| I-2 | 25.4 | 89.6 | 35.6 | 4.8 |
| I-3 | 28.3 | 90.7 | 37.8 | 6.3 |
| I-4 | 17.2 | 90.4 | 38.1 | 5.1 |
| I-5 | 16.4 | 91.2 | 40.0 | 5.4 |
| I-6 | 17.6 | 91.7 | 36.5 | 5.3 |
| I-7 | 25.4 | 90.9 | 37.8 | 6.2 |
| I-8 | 10.8 | 89.2 | 40.6 | 4.9 |
| I-9 | 9.6 | 90.3 | 41.7 | 4.8 |
| I-10 | 9.9 | 88.2 | 39.4 | 4.9 |
| Comp. Ex. | | | | |
| I-1 | 23.2 | 23.4 | 43.4 | 43.5 |
| I-2 | 91.0 | 91.8 | 5.0 | 5.0 |

II. Image-receiving sheet having an image-receiving layer composed mainly of a particular polyester resin:

The image-receiving sheet according to the second aspect of the present invention comprises a substrate sheet and an image-receiving layer, said image-receiving layer being composed mainly of a polyester resin comprising an acid moiety and a diol moiety of a modified bisphenol A represented by the following general formula (I):

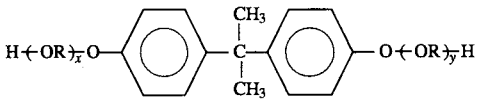

(I)

wherein R represents an ethylene or propylene group and x and y are each an integer of 1 to 5, provided that the average of each of x and y is 1 to 3.

Examples of the substrate sheet used in the image-receiving sheet according to the present invention include films of polyesters, polyolefins, such as polyethylene and polypropylene, polycarbonate, triacetate, polyethersulfone (PES), polyether ether ketone (PEEK), polyvinyl chloride, various acrylic resins including polymethyl methacrylate and cellophane. Among them, polyester, hard vinyl chloride resin, polypropylene and triacetate films are preferred. The substrate sheet may be subjected to undercoating for the purpose of improving the adhesion to the image-receiving layer. The thickness of the substrate sheet used in the present invention may be properly determined depending upon recording means to be employed, necessary strength and the like. It, however, is usually in the range of from 10 to 300 μm, preferably in the range of from 70 to 130 μm.

The resin for forming the image-receiving layer provided on the surface of the substrate sheet is composed mainly of a polyester resin comprising an acid moiety and diol moiety of a modified bisphenol A represented by the following general formula (I):

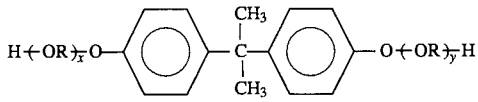

(I)

wherein R represents an ethylene or propylene group and x and y are each an integer of 1 to 5, provided that the average of each of x and y is 1 to 3.

The expression "composed mainly of polyester resin" used herein is intended to mean that at least 50% by weight of the whole resin component constituting the image-receiving layer is accounted for by the polyester resin.

Fumaric acid, phthalic acid, terephthalic acid, isophthalic acid, maleic acid, succinic acid, adipic acid, citraconic acid, itaconic acid, sebacic acid, malonic acid, hexacarboxylic acid and the like may be used as the acid moiety.

A polyester resin comprising as the diol moiety a propylene glycol-modified bisphenol A represented by the following formula (II) and as the acid moiety fumaric acid is most preferred because it has a good compatibility with a resin for fixing the toner and can provide a good print image.

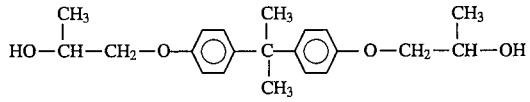

(II)

It is also possible to use the above polyester resin in combination with other resins commonly used for forming an image-receiving layer, for example, polyolefin resins, such as polyethylene and polypropylene, polyvinyl chloride, polyvinylidene chloride, polyvinyl acetate, vinyl chloride/vinyl acetate copolymer, polyacrylic esters, polyethylene terephthalate, polybutylene terephthalate, polystyrene resins, polyamide resins, copolymers of olefins, such as ethylene and propylene, with other vinyl monomers, ionomers, cellulosic resins, such as ethyl cellulose and cellulose acetate, and polycarbonate resins.

The image-receiving layer may be formed by adding various optional agents to the above resin component, dissolving or dispersing the mixture in a suitable solvent to prepare a coating composition, coating the composition on a substrate sheet by any conventional method and drying the resultant coating. The thickness of the image-receiving layer is usually in the range of from 1 to 20 μm.

Organic or inorganic fine particles may be incorporated in the image-receiving layer, and the average particle diameter of the fine particles is preferably in the range of from 0.1 to 10 μm. For example, fine particles of fluoropolymers, such as an ethylene tetrafluoride polymer and an ethylene/ethylene tetrafluoride copolymer, salts of stearic acid, such as zinc stearate, organic polymers, such as polyethylene, polystyrene, nylon and benzoguanamine, fine particles of inorganic substances, such as silica, colloidal silica and alumina, may be used for the purpose of imparting lubricity to the image-receiving layer. Further, wax, silicone oil, surfactants, vegetable oils, animal oils, mineral oils and the like may also be incorporated in the image-receiving layer for the same purpose. Among the above-described additives, fluoropolymers are best suited for imparting the lubricity because they, as such, have an excellent surface lubricity.

Further, in order to prevent a plurality of image-receiving sheets from being conveyed together in an overlapped state due to blocking likely to occur when the image-receiving sheet is fed to a printer, fine particles of organic polymers, for example, polyolefins, such as polyethylene, polystyrene, polyacrylonitrile and an ethylene/acrylic acid copolymer, fine particles of inorganic substances, for example, silica, colloidal silica, kaolin, clay, talc, silica rock, aluminum hydroxide, titanium dioxide, calcium carbonate, aluminum sulfate and zinc oxide, and fine particles of glass beads may be incorporated in the image-receiving layer in such an amount as will not be detrimental to the transparency of the image-receiving layer.

The amount of these fine particles incorporated is preferably in the range of from 0.1 to 10 parts by weight based on 100 parts by weight of the resin for forming the image-receiving layer.

If the content of the fine particles is higher than the above upper limit, the transparency of the image-receiving sheet is lowered. When it is necessary for the image-receiving sheet to be transparent, the haze is preferably not more than 10. In this case, the amount of the fine particles incorporated is preferably in the range of from 0.1 to 3 parts by weight based on 100 parts by weight of the resin for forming the image-receiving layer.

The image-receiving layer may further comprise, incorporated therein or present on the surface thereof, an antistatic agent, and examples of the antistatic agent include cationic antistatic agents, such as quaternary ammonium salts and polyamine derivatives, anionic antistatic agents, such as alkyl phosphates and nonionic antistatic agents, such as fatty acid esters. Further, it is possible to use resin type antistatic agents comprising acrylic or other resins with the above-described antistatic agents grafted thereonto.

The amount of the antistatic agent used is preferably in the range of from 0.1 to 5 parts by weight based on 100 parts by weight of the resin for forming the image-receiving layer.

If the content of the antistatic agent exceeds the above upper limit, the properties inherent in the image-receiving layer are deteriorated, while if the content of the antistatic agent is less than the above lower limit, the antistatic effect attained is unsatisfactory.

When an antistatic layer is provided on the back surface of the transparent substrate sheet, the antistatic agent described above may be diluted with a solvent, such as an alcohol, and coated on the back surface of the substrate sheet by gravure printing, spray coating or other methods to form an antistatic layer having a thickness of 0.02 to 3 μm.

Further, a detection mark having a desired pattern of usually 0.5 to 10 μm in thickness can be formed on the surface of the image-receiving layer or on the back surface of the substrate sheet by any conventional method or by the method described above in connection with the first aspect of the present invention. When the detection mark is formed on the back surface of the substrate sheet, it may be formed between the substrate sheet and the antistatic layer or alternatively on the surface of the antistatic layer remote from the image-receiving layer.

The second aspect of the present invention will now be described in more detail with reference to the following examples and comparative example, wherein all parts and % are by weight unless otherwise specified.

EXAMPLE II- 1

At the outset, a 100 μm-thick transparent polyethylene terephthalate film (T-60 manufactured by Toray Industries, Inc.) was provided as a substrate sheet, and a coating solution having the following composition for an image-receiving layer was coated thereon by means of a bar coater at a coverage of 5.0 g/m$^2$ on a dry basis to form a image-receiving layer, thereby providing an image-receiving sheet.

| Coating solution 1 for image-receiving layer | |
|---|---|
| Polyester resin (polymerization product of fumaric acid with propylene glycol-modified bisphenol A) (Tg: 60° C., softening point: 100° C.) | 30 parts |
| Methyl ethyl ketone:toluene = 1:1 | 70 parts |
| Fine particles of silica (average particle diameter: 5 μm) | 0.15 part |

EXAMPLE II- 2

An image-receiving sheet was prepared in the same manner as in Example II- 1, except that a coating solution 2 having the following composition for an image-receiving layer was used instead if the coating solution 1 for an image-receiving layer.

| Coating solution 2 for image-receiving layer | |
|---|---|
| Polyester resin (polymerization product of fumaric acid with propylene glycol-modified bisphenol A) (Tg: 60° C., softening Point: 100° C.) | 30 parts |
| Antistatic agent (TB-34 manufactured by Matsumoto Yushi Seiyaku Co., Ltd.) | 0.2 part |
| Methyl ethyl ketone:toluene = 1:1 | 70 parts |

EXAMPLE II-3

The same image-receiving sheet as prepared in Example II-1, comprising a substrate sheet and, formed thereon, an image-receiving layer, was provided, and a coating solution having the following composition for an antistatic layer was coated on the outer surface of the image-receiving layer and on the back surface of the substrate sheet, i.e., the surface of the substrate sheet remote from the image-receiving layer, so that the coverage on a dry basis of each antistatic layer was 0.1 g/m$^2$. Thereafter, a detection mark according to the first embodiment of the present invention was printed at a coverage on a dry basis of 2 to 3 g/m$^2$ on the antistatic layer provided on the back surface using an ink 1 having the following composition for a detection mark by gravure printing, thereby providing an image-receiving sheet.

| Coating solution for antistatic layer | |
|---|---|
| Antistatic agent (TB-34 manufactured by Matsumoto Yushi Seiyaku Co., Ltd.) | 1 part |
| Isopropyl alcohol | 500 parts |
| Ink 1 for detection mark | |

-continued

| | |
|---|---|
| Vinyl chloride/vinyl acetate copolymer resin (Denkalac manufactured by Denki Kagaku Kogyo K.K.) | 30 parts |
| Acrylic resin (Dianal manufactured by Mitsubishi Rayon Co., Ltd.) | 1 part |
| Poor solvent (n-butanol) | 25 parts |
| Acetone | 35 parts |

EXAMPLE II-4

An image-receiving sheet was prepared in the same manner as in Example II-1, except that a coating solution 3 having the following composition for an image-receiving layer was used instead of the coating solution 1 for an image-receiving layer.

| Coating solution 3 for image-receiving layer | |
|---|---|
| Polyester resin (polymerization product of succinic acid with diethylene glycol-modified bisphenol A) (Tg: 65° C., softening points 110° C.) | 30 parts |
| Methyl ethyl ketone:toluene = 1:1 | 70 parts |

EXAMPLE II-5

An image-receiving sheet was prepared in the same manner as in Example II-1, except that a coating solution 4 having the following composition for an image-receiving layer was used instead of the coating solution 1 for an image-receiving layer.

| Coating solution 4 for image-receiving layer | |
|---|---|
| Polyester resin (polymerization product of terephthalic acid with triethlyene glycol-modified bisphenol A) (Tg: 50° C., softening point: 70° C.) | 30 parts |
| Methyl ethyl ketone:toluene = 1:1 | 70 parts |

EXAMPLE II-6

An image-receiving sheet was prepared in the same manner as in Example II-1, except that a coating solution 5 having the following composition for an image-receiving layer was used instead of the coating solution 1 for an image-receiving layer.

| Coating solution 5 for image-receiving layer | |
|---|---|
| Polyester resin (polymerization product of adipic acid with dipropylene glycol-modified bisphenol A) (Tg: 70° C., softening point: 110° C.) | 30 parts |
| Methyl ethyl ketone:toluene = 1:1 | 70 parts |

EXAMPLE II-7

An image-receiving sheet was prepared in the same manner as in Example II-1, except that a coating solution 6 having the following composition for an image-receiving layer was used instead of the coating solution 1 for an image-receiving layer.

| Coating solution 6 for image-receiving layer | |
|---|---|
| Polyester resin (polymerization product of terephthalic acid with tripropylene glycol-modified bisphenol A) (Tg: 55° C., softening point: 90° C.) | 30 parts |
| Methyl ethyl ketone:toluene = 1:1 | 70 parts |

COMPARATIVE EXAMPLE II-1

An image-receiving sheet was prepared in the same manner as in Example II-1, except that a coating solution 7 having the following composition for an image-receiving layer was used instead of the coating solution 1 for an image-receiving layer.

| Coating solution 7 for image-receiving layer | |
|---|---|
| Polyester resin (polymerization product of succinic acid with ethylene glycol) (Tg: 60° C., softening point: 100° C.) | 30 parts |
| Methyl ethyl ketone:toluene = 1:1 | 70 parts |
| Evaluation method: | |

The image-receiving sheets obtained in the above examples and comparative example were subjected to color printing using a color test chart No. 11 of The Institute of Image Electronics Engineers of Japan by means of a multi-color copying machine CLC-200 manufactured by Canon Inc. Then, the images projected by OHP and graying (clouding of the image projected by OHP) were evaluated by visual observation, and the surface electric resistance was measured under the environmental conditions of 20° C. and 60% relative humidity to evaluate the antistatic effect. The results are given in Table 2.

Further, for the detection mark prepared in Example II-3, the transmittance and reflectance at 950 nm were measured in the same manner as set forth on page 17. As a result, the transmittance was found to be 11.0% before copying, and 90.4% after copying. The reflectance was found to be 38.7% before copying, and 4.6% after copying. The detection mark was not observed in the image projected by OHP.

TABLE 2

| Example No. | Quality of image | Graying | Surface electric resistance |
|---|---|---|---|
| Ex. 1 | Good | No graying | Not less than $1 \times 10^{13}$ Ω |
| Ex. 2 | Very good | " | Not less than $1 \times 10^{5}$ Ω |
| Ex. 3 | " | " | Not less than $5 \times 10^{8}$ Ω |
| Ex. 4 | Good | Some graying | Not less than $1 \times 10^{13}$ Ω |
| Ex. 5 | " | " | Not less than $1 \times 10^{13}$ Ω |
| Ex. 6 | " | " | Not less than $1 \times 10^{13}$ Ω |
| Ex. 7 | " | " | Not less than $1 \times 10^{13}$ Ω |
| Comp. | " | Remarkable | Not less than |

TABLE 2-continued

| Example No. | Quality of image | Graying | Surface electric resistance |
|---|---|---|---|
| Ex. 1 | | graying | $1 \times 10^{13}\ \Omega$ |

What is claimed is:

1. An image-receiving sheet comprising:

a substrate sheet having an upper surface and a lower surface;

an image-receiving layer formed above said upper surface of said substrate sheet; and a detection mark formed above said image-receiving layer or below said lower surface of said substrate sheet, said detection mark comprising an opaque porous resin layer that becomes transparent upon heating, said opaque porous resin layer being formed by coating a resin varnish on said image-receiving sheet and drying the resultant coating, said resin varnish comprising a resin, a first solvent and a second solvent, wherein said first solvent has a lower boiling point than that of said second solvent and said resin is more soluble in said first solvent than in said second solvent.

2. The image-receiving sheet of claim 1, wherein said resin is selected from the group consisting of acrylic resin, polyester resin, vinyl chloride/vinyl acetate copolymer resin, and mixtures thereof.

3. The image-receiving sheet of claim 1, wherein said second solvent is present in an amount of 10 to 70 parts by weight based on 100 parts by weight of said resin.

4. The image-receiving sheet of claim 1, wherein said resin varnish further comprises a particulate lubricant.

5. The image-receiving sheet of claim 1, wherein said opaque porous resin layer has an average pore diameter ranging from 0.05 to 2 μm.

* * * * *